United States Patent [19]

Sarna et al.

[11] 4,213,520

[45] Jul. 22, 1980

[54] ARTISTS' PORTFOLIO

[76] Inventors: Abraham Sarna, 15, Bushey Ave., Woodford, Essex; David Sarna, 27, The Risings, London E. 17, both of England

[21] Appl. No.: 15,342

[22] Filed: Feb. 26, 1979

[30] Foreign Application Priority Data

Mar. 3, 1978 [GB] United Kingdom ..... 8561/78

[51] Int. Cl.[2] ..... A45C 11/00

[52] U.S. Cl. ..... 190/16; 206/45.23; 248/441 A; 248/461; 281/33

[58] Field of Search ..... 190/16; 248/441 A, 460, 248/461; 281/33; 206/44 B, 45.2, 45.23

[56] References Cited

U.S. PATENT DOCUMENTS

| | | | |
|---|---|---|---|
| 1,086,746 | 2/1914 | Babbitt | 190/16 |
| 2,076,683 | 4/1937 | Tharp | 281/33 UX |
| 3,091,482 | 5/1963 | Cirigliano | 281/33 |

*Primary Examiner*—Donald F. Norton
*Attorney, Agent, or Firm*—Emory L. Groff, Jr.

[57] ABSTRACT

This invention relates to an artists' portfolio, for the purpose of retaining and transporting sheet material such as prints or photographs, in a manner affording protection during carriage but enabling the contents to be displayed individually when required. The portfolio has two covers 1 and 2 joined at 3 which may be brought into juxtaposition and secured by a slide fastener 5 and flap 6 having a catch 7. The cover 1 includes a spine 10 joined with a support board 12 which may be positioned to engage lugs 13 so as to form an "easel" structure. Transparent folders are secured to the spine 10 by rings 15. In this construction both sides of the transparent folders may be displayed by either lying on support 12 or cover 1. Further the folders depend from the rings when in a normal position of carriage ensuring the contents are always flat in a suspended state.

9 Claims, 4 Drawing Figures

FIG.1.
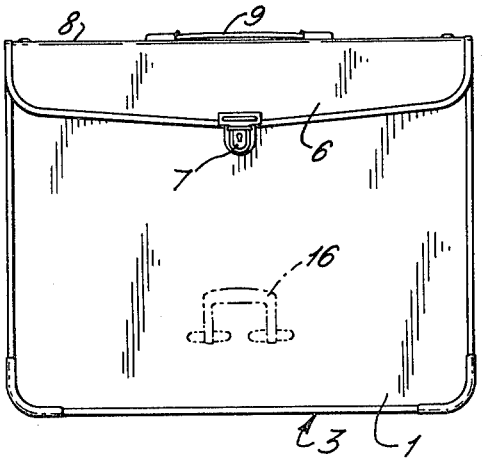
FIG.2.
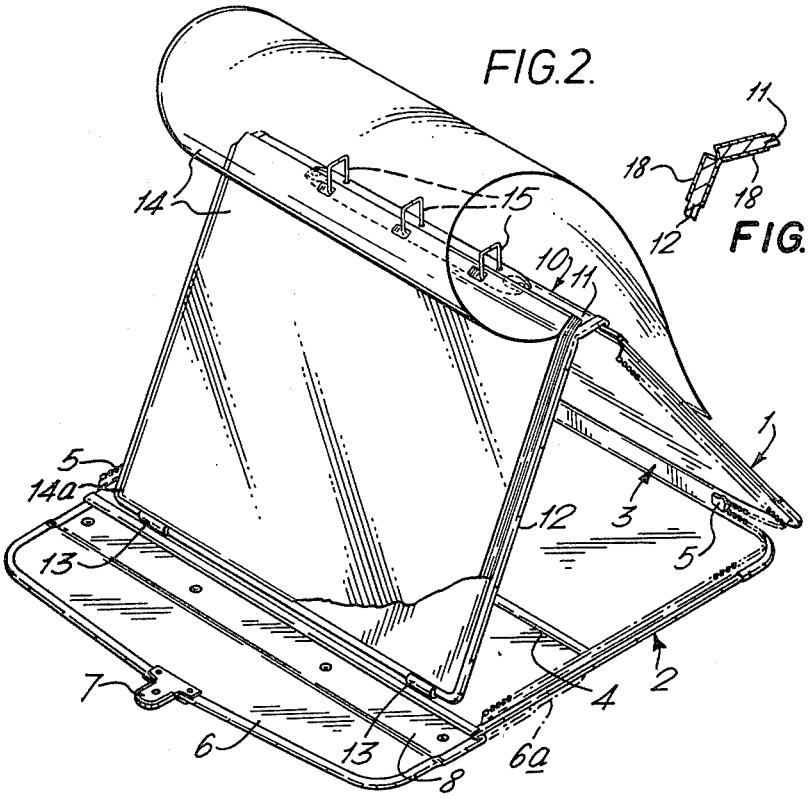
FIG. 2a.

ARTISTS' PORTFOLIO

BACKGROUND OF INVENTION

This invention relates to an artists' portfolio, for the purpose of retaining and transporting sheet material such as prints or photographs, in a manner affording protection during carriage but enabling the contents to be displayed individually when required. It is an object of this invention to provide a portfolio in which the sheet material is fully protected when closed and which may be opened in a simple manner, and which enables both sides of the sheet material to be displayed over an easel-like structure formed from the portfolio parts.

SUMMARY OF INVENTION

According to this invention there is provided an artists' portfolio comprising two outer covers joined so as to open and close book-fashion to form a case, co-operating closure means on adjacent free sides of each cover being provided, the side of one cover opposite to the side thereof joined to the other cover including a spine with securing means for sheet material and a support which may be swung from a position lying between the covers when the case is closed to a position in which a free side of the support bears on or near the side of the other cover opposite to the side thereof joined to the one cover, whereby a triangular structure is formed with the sheet material to lie against either the flat support or the one cover.

The spine preferably comprises a rigid portion flexurally joined along respective sides to the support, which may be a flat board, and the cover, the spine having a ring-like securing means to hold sheet material or preferably a plurality of transparent folders. The arrangement provides for the sheet material to be displayed in a manner affording ready viewing and each sheet may be successively turned over to display the next. The reverse side of a sheet may be displayed on the other side of the triangular structure, the spine preferably being arranged to allow the sheets to lie flat in either position of display.

The closure means of the free sides of the covers adjacent the joined sides preferably comprises a slide fastener means but may be simply an overlap of material to protect the contents. The closure means on the free sides of the covers opposite the joined sides preferably comprises a flap on one cover with fastening means engageable with means provided on the other cover and conveniently including a locking device.

Further features are shown in an artists' portfolio illustrated in the accompanying drawings by way of an example. In the drawings:

BRIEF DESCRIPTION OF DRAWINGS

FIG. 1 is a face view of the portfolio closed,

FIG. 2 shows, in perspective, the portfolio opened up for display of the contents, and FIG. 2A shows an enlarged detailed view of the circled portion of FIG. 2

DESCRIPTION OF PREFERRED EMBODIMENTS

Figure 3:
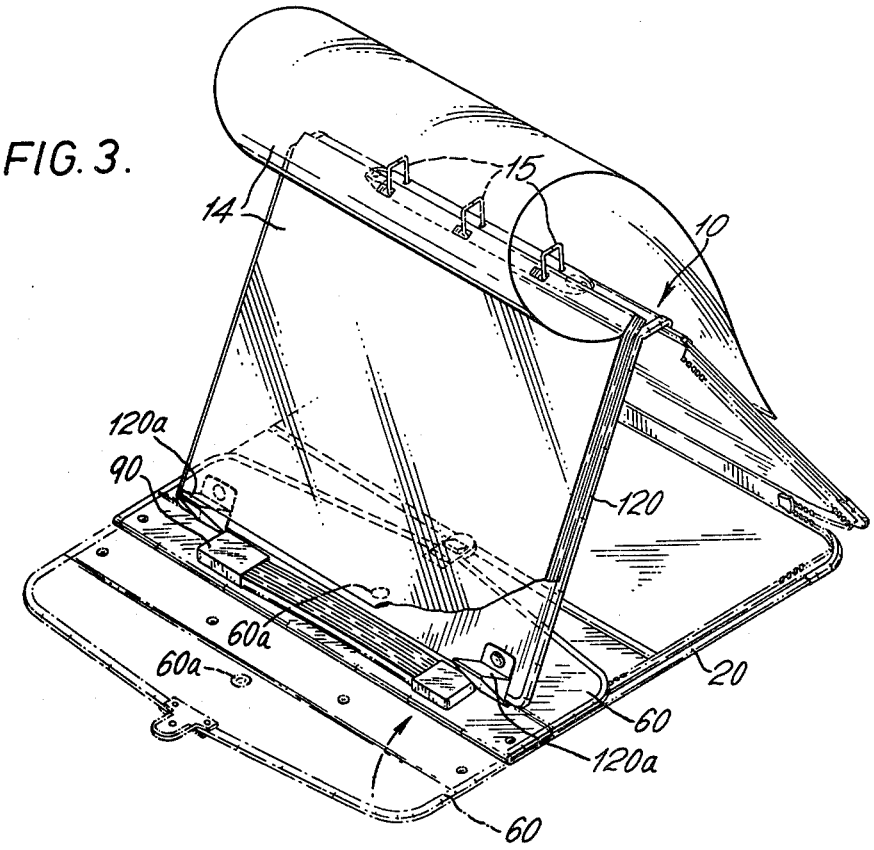
FIG. 3 shows, in perspective, a modification of a portfolio.

Referring to the drawings, the portfolio comprises a first outer cover 1 and a second outer cover 2 joined at 3 so as to open and close in book fashion. The covers may be formed from rigid board with a covering of plastics material such as a synthetic leather material, and the joint may be of of the same material with appropriate connection to the respective covers. The second cover has a pocket 4 on the inside surface. The covers may be brought together and closed by means of slide fasteners 5, on opposed sides adjacent the joined sides 3, and by a flap 6 formed as an extension of the cover 2 and foldable over the cover 1 to be secured by a lockable fastening catch 7. The flap 6 has a spine portion 8 with a handle 9 secured thereon.

The side of cover 1 opposite to the joint 3 has a spine 10 comprising a rigid strip 11 flexibly joined to the cover 1 and to a support board 12 by respective sides. The board 12 may be covered with a synthetic leather material and the free side of the support opposite spine 10 engages lugs 13 near the side of cover 2. In this way a triangular "easel" like structure is formed and transparent folders 14 secured to spine 10 by rings 15 lie either against the support 12 or, by turning same over, against the cover 1. One folder is shown during the turning over and in the final position will lie adjacent cover 1.

In the closed position the support 12 is moved to lie adjacent cover 1 which then is closed upon cover 2, whereby support 12 and folders 14 are protected between the covers which are secured by fasteners 5 and flap 6.

The spine 10 is adjacent the handle 9 and thus in normal carriage sheet material remains towards the base 14*a* of the folders. The lugs 13 may comprise a strip member and any form of abutment may be used as convenient to prevent the easel collapsing.

Portions of the structure may include metal reinforcement as necessary (for example in the spines 8 and 10). When closed the spine 10 lies flat against cover 1 in the plane of the support 12, with the rings 15 abutting the cover 2 and providing spacing between the covers at that end near flap 6.

For larger sizes of portfolio, such as for A1 size sheets, it is convenient to provide a handle 16 for carrying at a position towards the bottom of side 1. This enables the case to be carried partly beneath the arms.

The flap 6 is preferably secured to side 2 in a manner which allows same to be folded under to lie flat beneath this side, as at 6*a*, when in the display position of FIG. 2. This gives a neater appearance when the case is opened for display.

The material forming board 12 and spine strip 11 will preferably be thick with squared-off abutting edges joined by two pieces of adhesive tape material 18 as illustrated in FIG. 1A. This construction allows the two parts to hinge in one direction only so that with a weight of folders 14 the parts become coplanar and the spine does not tend to "sink". With folders against side 1 the spine part tends to become coplanar with this side as the joint freely hinges in the direction allowing this.

FIG. 3 shows a modification which, in essential aspects, is the same as the portfolio of FIGS. 1 and 2 and only those parts which differ are referenced and described hereafter. In this embodiment the flap 60 is effectively an integral extension of side 20 and is arranged to fold to lie over this side as shown in full lines. In such position the handle assembly 90 forms the abutment for the edge of board 120 instead of lugs 13. The flap is retained in this position by means of a two part press stud fastener 60*a* on flap 60 which engages the second part (not illustrated) on side 20.

A further improvement is the provision of support lugs 120*a* on which the bottom of the folders 14 may rest thus relieving tension from the spine 10 and rings 15.

We claim:

1. An improved artists' portfolio comprising two outer covers joined so as to open and close book-fashion to form a case, co-operating closure means on adjacent free sides of each cover characterised in that the side of one cover opposite to the side thereof joined to the other cover includes a spine with securing means for sheet material and a flat rigid support connected to said spine which may be swung from a position lying between the covers when the case is closed to a position in which a free side of the support bears on or near the side of the other cover opposite to the side thereof joined to the one cover, whereby a triangular structure is formed with the sheet material to lie against either said support or the one cover, a closure means for securing together the sides of the covers opposite to the joined sides said closure means comprising a flap on the other cover with a fastening means engageable with means provided on the one cover.

2. A portfolio in accordance with claim 1, wherein the spine comprises a rigid strip portion flexurally joined at one side to the support and at the other side to the said one cover.

3. A portfolio in accordance with claim 1, wherein the spine carries rings serving to retain sheet material.

4. A portfolio in accordance with claim 1, wherein the said cooperating closure means for the free sides of the covers which are contiguous to the joined sides of the covers comprise slide fasteners.

5. A portfolio in accordance with claim 1, wherein said flap includes a carrying handle on a part thereof constituting a spine.

6. A portfolio in accordance with claim 5, wherein said flap is arranged to overlie the other cover with the handle forming an abutment against which the free side of the support bears.

7. A portfolio in accordance with claim 6, wherein said flap and the other cover have cooperating fastening means.

8. A portfolio in accordance with claim 1, wherein said other cover includes lugs against which the free side of the support may bear to retain the support and one cover erect.

9. A portfolio in accordance with claim 1, wherein said free side of the support includes lugs on which the bottom of the sheet material may bear to relieve weight from the spine.

* * * * *